United States Patent [19]

Chaffy et al.

[11] Patent Number: 4,713,161

[45] Date of Patent: Dec. 15, 1987

[54] DEVICE FOR CONNECTION BETWEEN VERY HIGH INTENSITY ELECTROLYSIS CELLS FOR THE PRODUCTION OF ALUMINIUM COMPRISING A SUPPLY CIRCUIT AND AN INDEPENDENT CIRCUIT FOR CORRECTING THE MAGNETIC FIELD

[75] Inventors: Joseph Chaffy; Bernard Langon; Michel Leroy, all of St. Jean de Maurienne, France

[73] Assignee: Aluminium Pechiney, Paris, France

[21] Appl. No.: 870,919

[22] Filed: Jun. 5, 1986

[30] Foreign Application Priority Data

Jun. 5, 1985 [FR] France ..... 85 08924

[51] Int. Cl.[4] ..... C25C 3/16

[52] U.S. Cl. ..... 204/243 M; 204/244

[58] Field of Search ..... 204/243 M, 244, 67

[56] References Cited

U.S. PATENT DOCUMENTS

| | | | |
|---|---|---|---|
| 3,616,317 | 10/1971 | McLellan et al. | 204/243 M X |
| 4,090,930 | 5/1978 | Morel et al. | 204/243 M X |
| 4,169,034 | 9/1979 | Morel et al. | 204/243 M |
| 4,194,958 | 3/1980 | Nebell | 204/243 M |
| 4,196,067 | 4/1980 | Friedli | 204/243 M |
| 4,425,200 | 1/1984 | Arita | 204/243 M X |

*Primary Examiner*—Donald R. Valentine

*Attorney, Agent, or Firm*—Dennison, Meserole, Pollack & Scheiner

[57] ABSTRACT

The invention relates to a circuit for electrical connection between two successive cells of a series or row, designed for the production of aluminium by electrolysis of alumina dissolved in molten cryolite by the Hall-Heroult process at an intensity of at least 150 kA and possibly attaining from 500 to 600 kA. The circuit for the electrical supply of the cells comprises, in addition to the circuit 8 for the supply of electrolysis current, a distinct circuit 17 for correcting and balancing the magnetic fields which is formed by conductors which are substantially parallel to the axis of the series and are traversed by a direct current in the same direction as the electrolysis current which creates, in the cells, a vertical correcting magnetic field directed downwards close to the left-hand heads of the cells and directed upwards close to the right-hand heads of the cells. The total current J2 traversing the magnetic correcting circuit is at most equal to the electrolysis current J1 and is preferably between 4 and 80% of J1.

14 Claims, 9 Drawing Figures

FIG. 1

DEVICE FOR CONNECTION BETWEEN VERY HIGH INTENSITY ELECTROLYSIS CELLS FOR THE PRODUCTION OF ALUMINIUM COMPRISING A SUPPLY CIRCUIT AND AN INDEPENDENT CIRCUIT FOR CORRECTING THE MAGNETIC FIELD

SUBJECT OF THE INVENTION

The invention relates to a device for electrical connection between the successive cells of a series for the production of aluminium by electrolysis of alumina dissolved in molten cryolite, by the Hall-Heroult process, and comprising an independent circuit for correcting the undesirable effects caused by the magnetic fields. It is applied to series of cells arranged transversely to the axis of the series operating at a current greater than 150,000 amperes and possibly attaining from 500 to 600 Ka, without this value constituting a limit to the field of application of the invention.

TECHNICAL FIELD OF THE INVENTION

For good understanding of the invention, it should firstly be remembered that the industrial production of aluminium is effected by igneous electrolysis, in cells which are connected electrically in series, of a solution of alumina in molten cryolite brought to a temperature of the order of 950° to 1,000° C. by the heating effect of the current traversing the cell.

Each cell is constituted by an insulated parallelepiped metal container supporting a cathode constituted by carbon blocks in which there are sealed some steel rods known as cathode rods which serve to discharge the current from the cathodes towards the anodes of the following cell. The anode system, also composed of carbon, is fixed on a so-called "cross head" or "anode frame" anode rod which is adjustable in height and is electrically connected to the cathode rods of the preceding cell.

The electrolysis bath, that is the solution of alumina in the molten cryolite at 930°-960° C. is located between the anode system and the cathode. The alumina produced is deposited on the cathode. A layer of liquid aluminium is kept permanently on the base of the cathode crucible.

As the crucible is rectangular, the anode frame supporting the anodes is generally parallel to its large sides whereas the cathode rods are parallel to its small sides known as cell heads.

The cells are arranged in lines and are disposed lengthwise or, nowadays, usually transversely depending on whether their large side or their small side is parallel to the axis of the line. The cells are connected electrically in series, the ends of the series being connected to the positive and negative outputs of an electric rectification and control sub-station. Each series of cells comprises a certain number of lines which are connected in series, the number of lines preferably being even so as to minimise the lengths of the conductors.

The electric current traversing the various conducting elements: electrolyte, anode, liquid metal, cathodes, connecting conductors, creates large magnetic fields. These fields induce in the electrolysis bath and in the liquid metal contained in the crucible so-called Laplace forces which, by the deformation of the upper surface of the molten metal and the movements which it produces, are harmful to the steady operation of the cell. The design of the cell and of its connecting conductors is such that the effects of the magnetic fields created by the various portions of the cell and the connecting conductors balance one another.

Numerous Patents relating to the arrangement of conductors for connecting one cell to the next have been filed. Our French Patent Application FR-A No. 2 505 368 which describes connecting conductors for cells operating at 280 kA can be mentioned in particular.

STATEMENT OF THE PROBLEM

Some arrangements are selected by the skilled person to cancel more or less perfectly the vertical component of the magnetic fields in the liquid metal and to render symmetrical and to reduce as far as possible the circulation of liquid metal and of liquid bath in the crucible.

The more or less perfect cancellation of the vertical component of the magnetic field is necessary for the following reasons:

The passage of the electric current in the supply conductors and in the conducting portions of the cell produces magnetic fields which cause movements in the liquid bath and metal and deformation of the metal-electrolysis bath interface. These movements of metal which agitate the electrolytic bath placed beneath the anodes can, if they are too great, short-circuit this element of bath by contact between the liquid metal and the anode.

The electrolysis yield is greatly diminished and the power consumption increases.

The skilled person knows that the form of the metal-bath interface and the movements of the liquid metal are closely dependent on the values of the vertical component of the magnetic field and of the more or less perfect symmetry of the horizontal components. The greatest reduction in the values of the vertical component of the field permits the depth between the highest points and the lowest points of the metal layer to be reduced and permits the magnetic forces creating the disturbances in this layer to be reduced.

The possible asymmetry relative to the large axis of the cell in the circulation of the metal has the following disadvantages:

1. Since the mechanical erosion by the metal of the slope of solidified cryolite is directly related to the rate of circulation of the metal, asymmetry in these rates of circulation would cause different erosion of the slopes on the two large sides of the cell.

2. The thermal exchanges between the metal and the slope of solidified cryolite are directly connected to the rates of circulation of metal: asymmetry of these rates of circulation would cause different thermal exchanges with the two large sides of the cell and would result in a difference in the shape of the slopes of one large side from the other which would be disadvantageous for exploitation of the cells.

The more the intensities of the cells increase, the more their dimensions increase and the more the layout of the connecting conductors becomes complicated because the sensitivity of a layer of metal to the magnetic fields increases with the size of the layer. Generally speaking, a fairly large proportion of the current issuing from the upstream portion of a cell is brought to the following cell after having passed round a cell head, and this lengthens the electric circuit all the more if the cell has large dimensions.

Furthermore, the effect of the magnetic fields created by the adjacent line cannot be neglected and possible asymmetry in design or compensating loops have to be added to the circuit to effect the compensation of these "adjacent line" effects.

It can thus be seen that, beyond 350,000 amperes, it becomes difficult to design cells which are economically comparable to the cells having an intensity of between 250,000 and 300,000 amperes because the gains on the investments expected as a result of the size of the cells are totally eliminated by the high cost of the conductor circuit which is lengthened and complicated far more quickly than the increase in the size of the cells.

Moreover, in order to arrange complex-shaped, bulky conductors between the cells, it is necessary to spread the cells apart and this further lengthens the electric circuit and increases the surface of the building required for protecting these cells. One might think of simplifying the circuit by allowing a certain instability in the layer of metal. This must be ruled out because the losses in the yield of electrolysis current (which is usually between 93 and 97%) would increase the operating costs such that the metal produced would not be economically competitive.

The problem therefore arises of designing connecting circuits between very high intensity cells which can attain 500 and 600 kA, for example, which meet the following three conditions:

minimum cost for construction and installation of the circuits, minimum bulk, in ground area, for the series of cells utilising these circuits, maximum magnetic stability, therefore maximum Faraday yield, bearing in mind the effects of adjacent line.

STATEMENT OF THE PRIOR ART

Devices for compensating magnetic effects by conductors arranged along the series and traversed by a current which is a small fraction of the electrolysis current have already been described before, for example the U.S. Pat. No. 3,616,317 (assigned to ALCAN) and U.S. Pat. No. 4 169 034 (=FR No. 2 425 482), assigned to ALUMINIUM PECHINEY. However, both Patents claim merely to compensate the adjacent line effect, that is an essentially vertical field of a sign which is constant over the entire surface of the cell, as revealed clearly by the description and the claims of these two Patents, and the process is applied to series of which the conductors for connection from cell to cell have been designed so as to allow normal operation, without adjacent line, correction of the adjacent line only occurring in a quasi-marginal fashion. The maximum intensity of the current in the compensating conductors does not exceed 25% of the total J of the series in U.S. Pat. No. 3 616 317 and 17% of the total J in U.S. Pat. No. 4 196 034.

In view of the object of these compensation circuits, it can be seen that they are designed to create a compensating magnetic field which keeps a sign which is constant over the entire cell, this sign being opposed so that of the vertical field created by the adjacent line of cells.

STATEMENT OF THE INVENTION

The invention relates to a connecting device, that is an arrangement of conductors allowing transversely arranged electrolysis cells to be operated at more than 150,000 amperes and up to 500,000 to 600,000 amperes with a current yield of from 93 to 97%, while greatly reducing the weight of the conductors for connection between cells and the distance between cells.

It is therefore a device allowing standardization of the circuits and simplification of their design so as to reduce their manufacturing costs.

It is finally a device allowing the magnetic field created by the adjacent lines to be compensated without excessive expenditure.

In the following description, we will therefore distinguish between two types of conductors:

conductors from cell to cell which are comparable to the electric circuits according to the prior art and provide the electrical supply for electrolysis, the independent conductors for balancing the magnetic fields.

The side of the electrolysis cell directed towards the axis of symmetry of the lines of cells will be called internal side. The external side will consequently be the other side of the cell.

The "right-hand head of the cell" will refer to the small side of the cell situated on the right-hand side of an observer placed in the axis of the line of cells and looking in the direction of the current traversing this line of cells.

The "left-hand head of the cells" will be the other small side of the cell.

If a new electrolysis cell having a very high intensity higher than 350 kA is considered, one may be tempted to apply the same methods as for current existing 200 to 300 kA cells, that is to design the conductors for connection from cell to cell so that the magnetic fields induced by all the circuits of each cell compensate one another so that the resulting field B has the following characteristics, on average, over the entire cell:

quadratic average of the vertical component $Bz < 10^{-3}$ Tesla.

horizontal component Bx: anti-symmetrical relative to the transverse axis of the cell (small axis).

horizontal component By: on average the closest possible to anti-symmetry relative to the longitudinal axis of the cell (large axis).

(It will be remembered that there is "anti-symmetry" when the two considered values are of the same absolute value but of opposing sign).

The present invention is based on a double idea which is entirely different from the conceptions of the prior art and involves separating the two functions, "transmission of the electrolysis current" which is to be rendered as simple and direct as possible and "balancing of the magnetic fields" which is to be effected by independent conductors.

To fulfill the first function:

(a) The conductors for connection from cell to cell, transmitting the electrolysis current, will firstly be designed by selecting a path which is as close as possible to the direct path so as to minimise the weight of immobilised aluminium, and the distance between cells (therefore the total surface area occupied on the ground by the series ), without worrying too much about the magnetic effects.

(b) They will be designed as one or more assemblies of substantially identical modules which will connect each group of cathode collectors of one cell of rank n in the line to each of the anode risers of the cell of rank n+1 in the line, which is translated by standardization of the structure and of the first installation of the conductors.

This new conception of the conductors having a direct route is generally translated, in the case of very high intensity cells, by a very unfavourable lay out of magnetic fields which may even by quite incompatible with normal operation of electrolysis cells. In fact, the vertical field created by the conductors from cell to cell, having a substantially direct route, is strongly positive in average over the left-hand half cell and strongly negative on average over the right-hand half cell (see FIG. 2). The second inventive idea involving correcting this unfavourable lay out of the magnetic fields with an assembly of independent balancing conductors arranged along the line or lines and on each side of the line concerned comes into play here and has the following characteristics:

(a) the balancing current circulates there in a direction identical to that of the electrolysis current in the line of cells so as to create a strongly negative correcting field on the left-hand half cell and a strongly positive correcting field on the right-hand half cell.

(b) Their layout is very simplified because they comprise substantially only straight lengths of aluminium rods (except at the changes of direction at the ends of the lines).

(c) Their energy consumption is very low because, if the sum of the intensities J2 passing in the independent conductors, which is at most equal to J1 and which may be between 5 and 80%, and preferably between 20 and 70% of the intensity J1 traversing the series, is relatively high, the voltage drop remains low and it is largely compensated by the gain in voltage resulting from the direct route of the connecting conductors.

(d) The sum of the weights of the circuits of conductors conveying the electrolysis current on the one hand and the field correcting current on the other hand is generally much lower, by 5 to 15% and even up to 25% (for J values close to 500 kA), than the weight required when using a single circuit which is automatically compensated magnetically. However, even for smaller cells, in which, for example, J is of the order of from 180 to 280 kA, such independent circuits are still of interest because, if little or nothing is gained over the total weight of cell to cell conductors, the modular and simplified design of the circuits again leads to a gain over the manufacturing and installation costs and over the space required between cells—therefore over the surface of the building required for protecting the cells.

(e) These independent correcting conductors allow a favourable configuration of the magnetic field of each cell to be re-established and at the same time allow the effects of adjacent lines to be compensated, by asymmetry of the intensity passing in the internal and external correcting conductors, without a significant increase in investment and operating costs.

More precisely, the present invention therefore relates to a device for electrical connection between two successive cells of a series intended for the production of aluminium by electrolysis of alumina dissolved in molten cryolite, by the Hall Heroult process, at a current of at least 150 kA and possibly attaining from 500 to 600 kA, each cell being constituted by an insulated parallelepiped metal container of which the large axis is perpendicular to the axis of the series and of which the two ends are called "heads", this container supporting a cathode formed by the juxtaposition of carbonaceous blocks in which there are sealed some metallic rods of which the ends leave the container, generally on the two large sides which are upstream and downstream (relative to the direction of the current in the series), each cell also comprising an anode system formed by at least one horizontal rigid beam supporting at least one and usually two horizontal conducting rods known as "anode frame", on which the anode suspension shafts are attached, this connection circuit comprising, in particular, a circuit for the transmission of the electrolysis current between two successive cells, constituted by cathode collectors which are connected on the one hand to the cathode outputs of the cell of rank n and on the other hand to connecting conductors which join, by risers, the anode frame of the cell of rank n+1 in the series. According to the invention, this connecting device also comprises an independent circuit for correcting and balancing the magnetic fields, which is formed by conductors which are substantially parallel to the axis of the series, this circuit being traversed by a direct current having the same direction as the electrolysis current and creating in the cells a vertical correcting magnetic field which is directed downwards close to the left-hand heads and is directed upwards close to the right-hand heads, the terms "left-hand" and "right-hand" being defined by reference to an observer placed on the axis of the line of cells and observing in the direction of flow of the electrolysis current.

The total current J2 traversing the magnetic correcting circuit is at most equal to the electrolysis current J1.

The term "independent" circuits denotes that the circuits follow distinct routes and fulfill different functions, which does not prevent them from possibly being supplied from the same source of direct current or by two branches from the same source.

In the circuit for the supply of electrolysis current:

the upstream cathode outputs of the cell of rank n are connected to upstream cathode collectors which join, via conductors of which the majority pass beneath said cell n, via a route close to the direct route, a first section of the risers which supply the anode frame of the cell of rank n+1 in the series;

the downstream cathode outputs of the cell of rank n are connected to downstream cathode collectors connected directly to a second section of the corresponding risers;

the circuit for the correction and balancing of the magnetic fields comprises two assemblies of conductors, for correction of field, which are independent from the connecting conductors and are arranged on either side of the line of cells parallel to the axis of the line and are supplied by a total current J2 circulating in the same direction as the current J1 supplying the series, at a total intensity J2 at most equal to J1 and generally between 5 and 80% of J1 and preferably between 20 and 70%.

DESCRIPTION OF THE FIGURES

FIG. 1 shows the nomenclature used in the description. The axis XOX is the axis of the line. It also shows the direction of circulation of the current and the small axis of the series, YOY being the large axis. The axis Oz represents the vertical axis.

FIG. 2 shows the vertical components of the magnetic field on a cell before and after correction according to the invention.

FIG. 3 shows very schematically the general route of the supply conductors and the correction conductors.

FIG. 4 show schematically an upstream-downstream connection module.

FIG. 5 shows schematically the arrangement of the correction conductors in a series of cells comprising two parallel lines A and B.

FIG. 6 shows in an isometric view, an upstream-downstream connection module between two successive cells of a line. Only the supply conductors have been drawn. The cathode outputs have been shown schematically.

FIGS. 7 and 8 show schematically the actual arrangement of the connecting and correction conductors in a high power series (for example 480 kA). FIG. 7 has been simplified (by reduction of the cell to 9 anodes) because it merely has the object of showing the position of the conductors (9) (beneath the cell) and the position of the conductors (17)(22)(field correction). FIG. 8 also shows a module for connection between two cells.

FIG. 9 shows an embodiment of the invention on a series of 280 kA cells.

In FIG. 3, the representation of two successive cells in a line has been limited to the contour 1 of the metal container.

Figure 1:
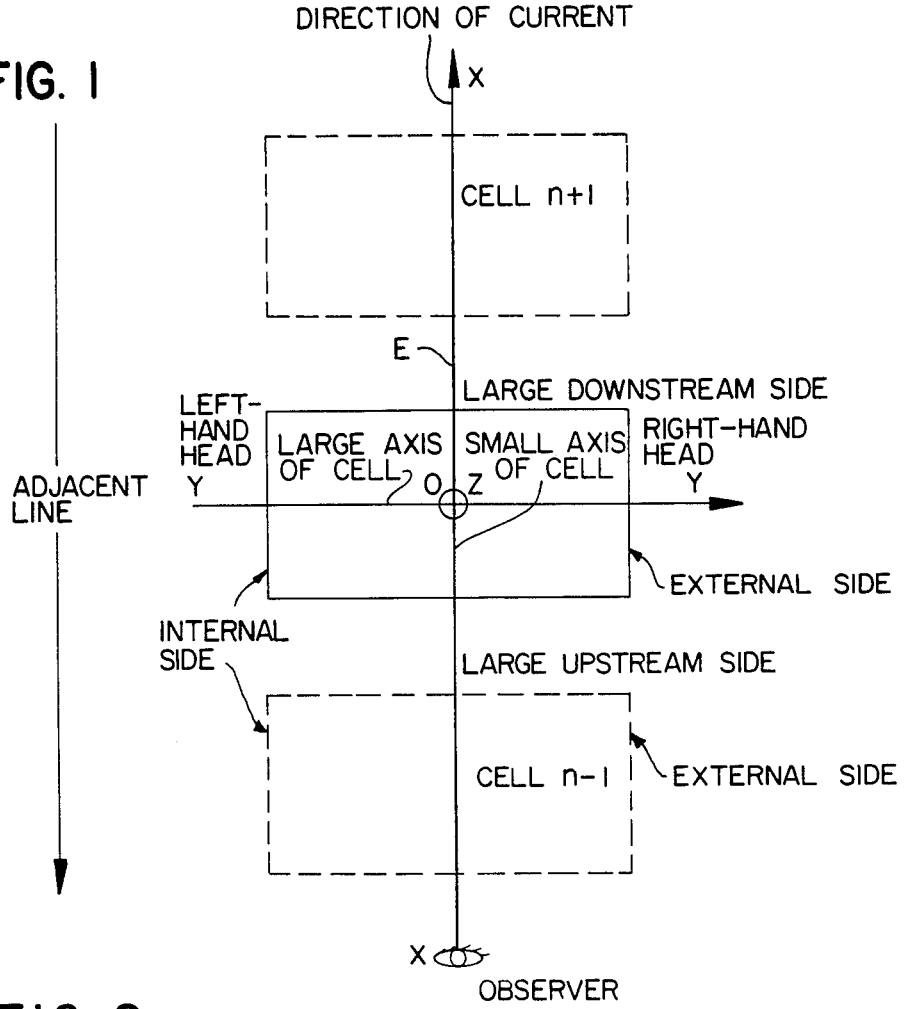
FIGS. 1 to 9 illustrate an embodiment of the invention.

The cathode outputs such as 2 which are drawn in thickened lines are connected to upstream cathode collectors such as 3, and similarly the downstream cathode outputs such as 4 are connected to downstream cathode collectors such as 5.

On a cell of this type provided, for example, for an intenstiy of 480 kA, there are for the entire cell 32 upstream cathode outputs and 32 downstream cathode outputs and two parallel lines of 32 anodes supported by shafts symbolised by crosses 6 on the downstream half cell. These cathode shafts are attached to the anode frame constituted by two elements 7A and 7B connected by equipotential rods 7C.

The electrical connection between the cathode collectors of the cell of rank n in the row and the anode frame of the cell of rank n+1 is provided by risers 8 of which there are eight in this case.

Each riser 8 is double. It comprises a branch 8A connected directly to a downstream cathode collector 5 and a branch 8B connected to an upstream cathode collector 3 by at least one connecting rod 9 passing beneath the cell following a path close to the most direct path. It should be emphasised that, in the technology of very high intensity electrolysis, the notion of direct path, does not necessarily mean a straight geometric line owing to the dimension of the conductors (an aluminium rod transmitting 100 ka generally has a cross section of the order of 3,000 square centimetres and may even be as much as 6,000 square centimetres in the case of a "long" circuit transmitting the current from the upstream cathode outputs of one cell (n) to the anode frame of the following cell (n+1)) which involves large radii of curvature, also owing to the amount of space required beneath the cells (metallic masses, ribs for reinforcing the container, support pillars for the containers) which may make it necessary to separate an excessively bulky rod into two or more parallel rods and owing to the need for electrical insulation, the voltage between the conductors and the metallic masses possibly attaining several hundred volts. The term "direct path" will be interpreted as the shortest path which meets the requirements enumerated above.

In the present case there are two connecting rods 9 for supplying each riser 8A, each rod 9 being connected to two upstream cathode outputs 2 by a collector 3. In addition to obtaining a minimum conductor weight for a given voltage drop, this assembly affords the advantage of allowing modular construction.

If one of these modules 14 is isolated (FIG. 6) it will be found that it is formed by the assembly of:

four downstream cathode outputs 4 of the cell n (shown schematically so as not to complicate the drawing).

the downstream cathode collector 5 and the corresponding riser 8A towards the anode frame 7A of the cell n+1.

the connecting conductor 13 connected on the one hand to two rods 9 passing beneath the cell n and on the other hand to the other half riser 8B.

two upstream cathode collector elements 3, 3' of the cell n+1 each connected to two upstream cathode outputs 2 of the cell n+1, shown schematically, and to the rod 9 passing beneath the cell n+1.

possibly the short-circuiting blocks 12 for temporarily switching off a cell.

The connecting rods 9 passing beneath the container 1 do not form part of the module. Their position may in fact vary from one module to another so as to adjust the lay out of the magnetic fields to the most favourable configuration. It will also be noted that the modules 14 situated on a half cell are generally symmetrical rather than identical to the modules situated on the other half cell (relative to the axis Ox).

This arrangement of conductors, as just described, gives a quite unacceptable magnetic field layout which is incompatible with stable operation of the cell at the intensities under consideration. By way of example, it will be pointed out that a maximum Bz possibly exceeding $120\text{-}10^{-4}$ Tesla (120 gauss) is obtained for a 480 kA cell produced according to this diagram.

Figure 2:
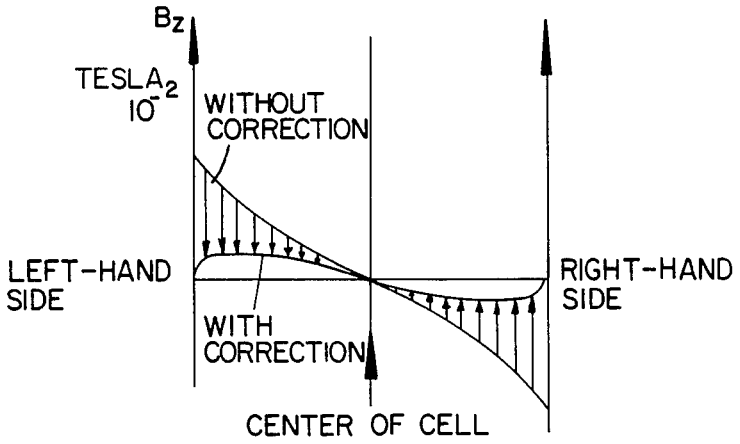
Figure 3:
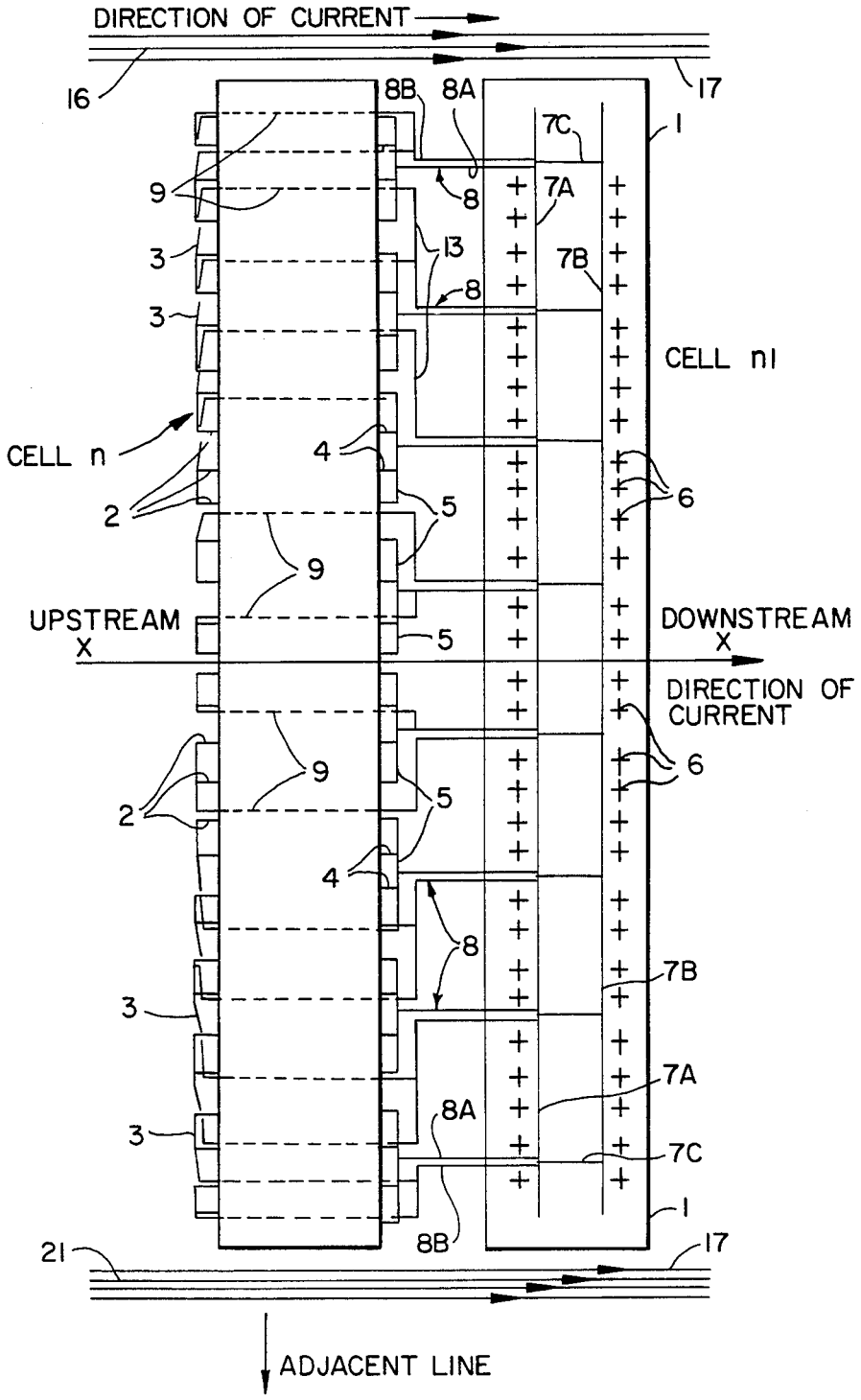
Figure 6:
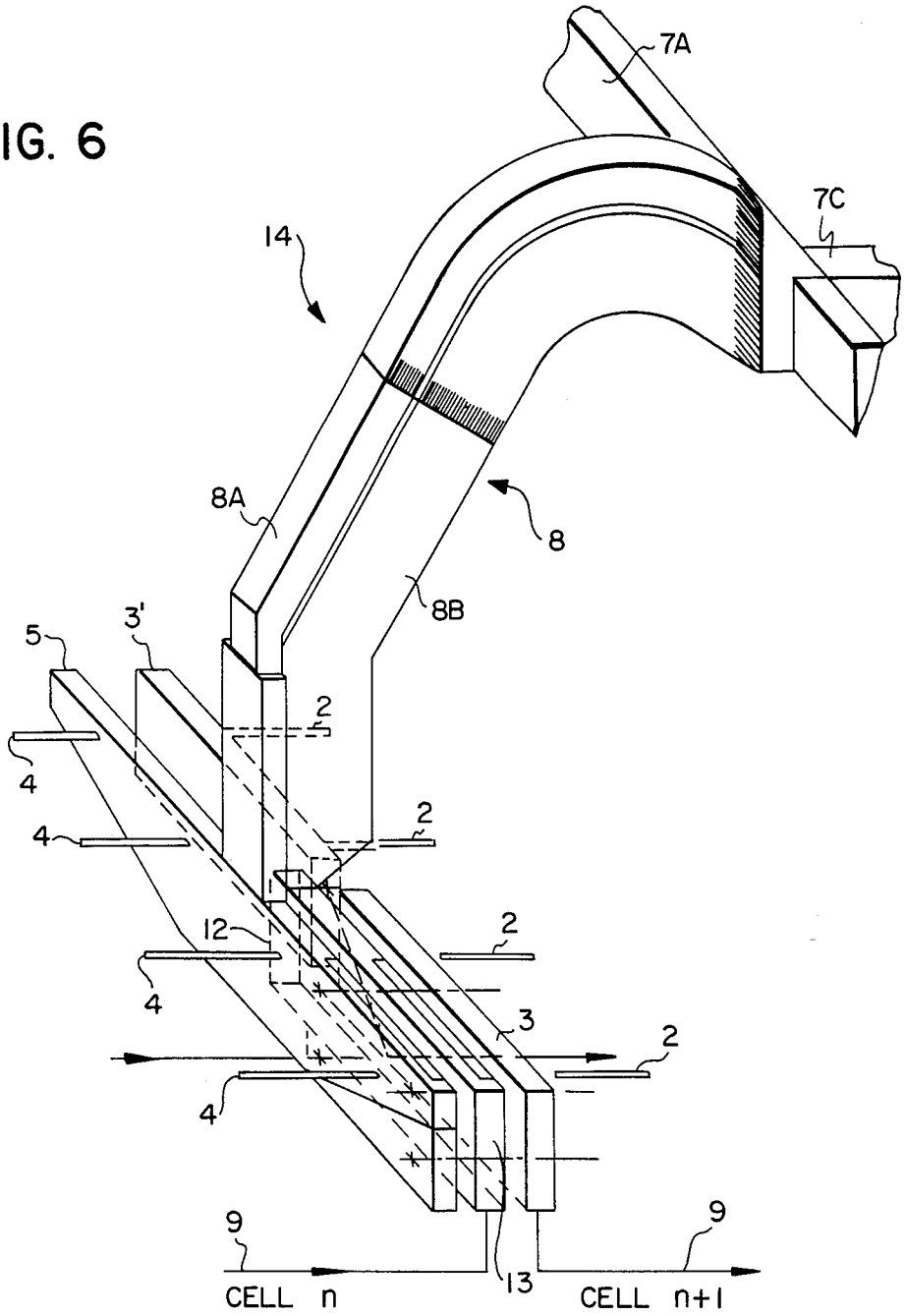
Figure 7:
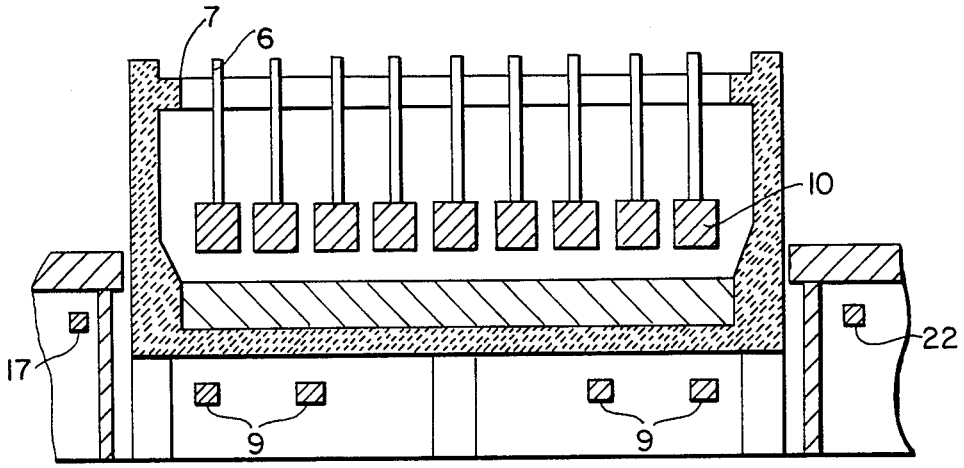
Figure 8:
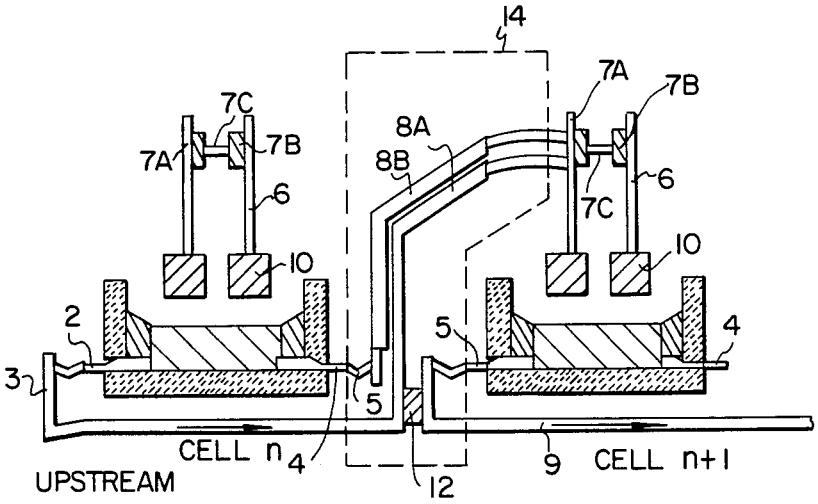

The correction and balancing of the magnetic field are allocated to an independent balancing circuit shown schematically in FIGS. 3 and 6 in which the arrows show the direction of the current in the lines of actual cells and in the balancing circuit. FIG. 2 shows the distribution of the vertical components of the magnetic field on the large axis of the cell before and after correction by the balancing circuit forming the subject of the invention. The values of By without correction are such that any normal operation of the cells would be impossible. We should point out that these values are taken in the region of the electrolysis bath/metal interface and in the vertical plane containing the largest axis of the cell.

Figure 4:
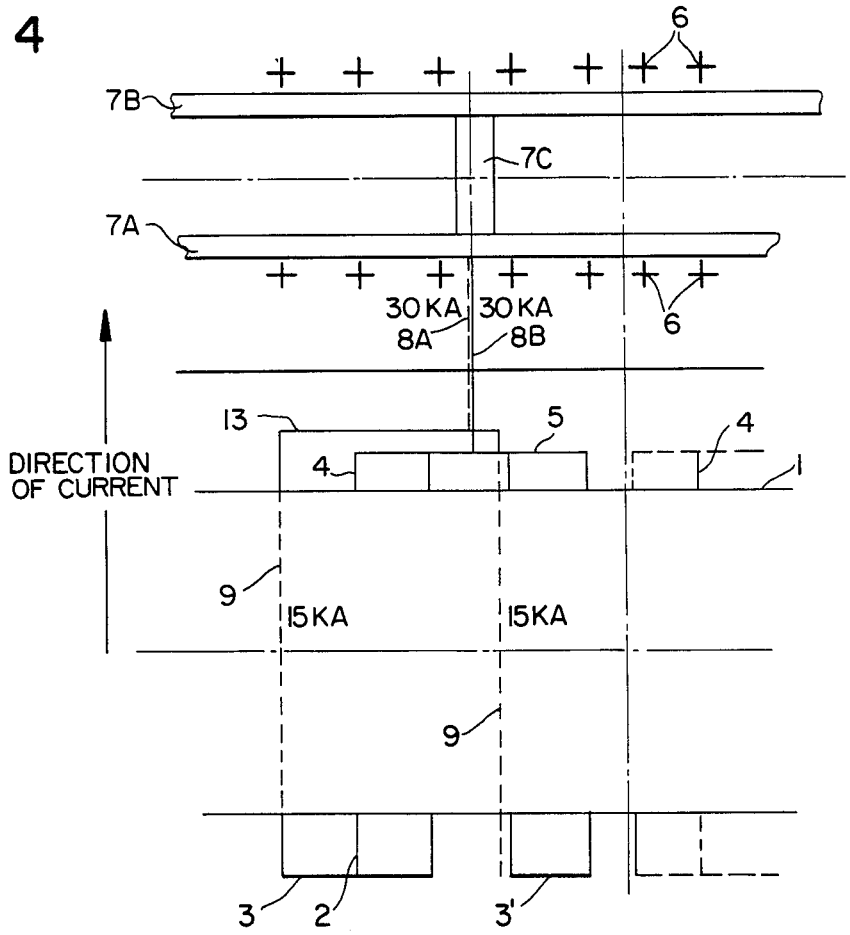
Figure 5:
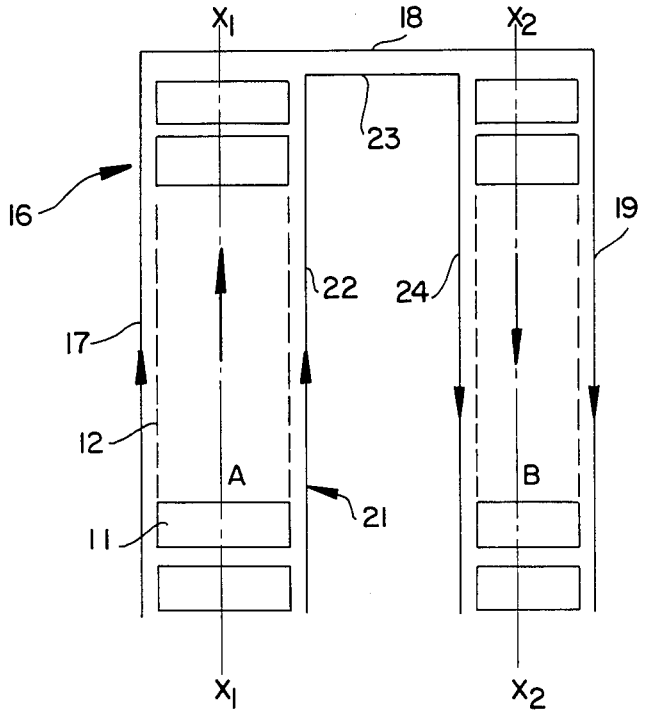

FIG. 5 shows the case of a series composed of two parallel lines A and B comprising a number of cells which may be as desired (for example 100). These cells are symbolised by a mere rectangle 11. The parallel axes X1,X1 and X2X2 are situated at a distance which may be of the order of 100 meters. The connections between each cell are produced according to the diagrams in FIGS. 3, 4 and 6.

According to the invention, an assembly of independent correcting conductors, distinct from the conductors for connection between the cells and situated substantially at the level of the layer of liquid aluminium and at a short distance from the external lateral walls of the cells (of the order of 0.5 to 2 meters for example) is arranged along the cells on either side of each row, each conductor or bundle of grouped conductors being traversed by a current having the same direction as the direction of the current in the row.

The first correcting conductor 16 comprises a first section 17 on the external side of the row A traversed by a current in the same direction as the current supplying this row A, then a connecting section 18 which turns round the head of the row A and the free space between the rows A and B then a section 19 on the external side of the row B, the current in this section 19 being in the same direction as that which supplies the series.

The second correcting conductor 21 comprises a first branch 22 which runs along the internal side of the row A, then a connecting section 23 which turns round the free space between the rows A and B, and a section 24 which runs along the internal side of the row B, the current in the sections 17 and 22 on the one hand and 19 and 24 on the other hand being in the same direction as that of the current supplying the corresponding line.

The total intensity J2 in the correcting conductors 16 and 21 is controlled so as to re-establish a layout of magnetic fields which allows normal operation, the stability and the optimum yield of all the cells in the series. This intensity is at most equal to J1 and is normally between at least 5% and up to 80% of the total intensity J1 supplying the actual row, and preferably between 20 and 70% of J1.

For example, for a row supplied at J1=480 kA, the correcting current could be fixed, for example, between 100 and 105 kA, in each external and internal branch of the correcting circuit, the value of J2 equal to twice 135 kA generally being close to the optimum for an isolated series without taking into consideration the adjacent line effect, the correcting conductor being arranged 1.5 meters from the external wall of the metal containers of the cells. This is an approximate value, the exact optimum value depending on the position relative to the container and to the level of the bath plus metal interface of the independent correcting conductors.

In the case of multiple lines (at least two) the skilled person knows that it is necessary to take into consideration the "adjacent line effect", that is the magnetic field induced over a line by the adjacent line or lines and of which the magnetic effects are added to those created over each cell by the current traversing it.

The present invention also allows the adjacent line effect to be compensated. For this purpose, the current is distributed in each of the assemblies of internal and external correcting conductors 16 and 21 in a manner different from that which permitted magnetic balancing in the absence of adjacent line. In this way, for two rows A and B of which the axes are 130 meters apart, the intensity J would be reduced by 130 to 120 kA in the external correcting conductor 16 and increased by 135 to 150 kA in the correcting conductor 21, the total intensity J 2 remaining equal to 270 kA, that is 56% of J1. If the distance between the axis of the lines is reduced to 65 metres, the intensity will be lowered to 105 kA in 16 and increased to 180 kA in 21, the total intensity J2 only thus being increased by 15 kA and settling at 285 kA, that is 60% of J1.

This is a way of bringing together the various lines or series constructed on the same site without damaging their overall stability, and the resultant reduction in the ground area required has numerous advantages: reduction in investment (purchase of land, surface area of the buildings to construct), length of the conductors and ducting of all types, and reduction in the journeys by operators, for transportation of raw materials and finished products, etc.

Finally, it should be noted that the compensation of the adjacent line effect by asymmetry of the intensity in the correcting conductors as just described could also be achieved or refined by other known methods, in particular by offsetting the upstream-downstream connecting rods 9 passing beneath the cell and by modification of the intensity in these various rods. The latter process can be used as the only method of compensating the effect of adjacent line or to complement the process of the invention by asymmetry of the intensity in the correcting conductors.

EMBODIMENT

Example 1

The invention has been applied a small experimental series of electrolysis cells arranged transversely to the axis of the series and operating at 480 kA. The arrangement of the conductors for connection between cells corresponds to that in FIGS. 3 and 4, each of the risers 8 (equals 8A+8B) transmitting 60 kA.

The upstream and downstream cathode outputs 2 and 4 number 32+32. On the large upstream side, two adjacent cathode outputs 2 are connected by a collector 3, connected to a rod 9 passing beneath the cell. There are therefore a total of 16 rods 9 passing beneath the cell, each transmitting 15 kA. Each group of two adjacent rods 9 joins, upstream, a connecting conductor 13 which is itself connected to the half riser 8A.

On the large downstream side, four cathode outputs 4 are connected to a downstream cathode collector 5 which therefore collects 30 kA and supplies the corresponding half riser 8B.

The distance between rods 9 passing beneath the cell may be altered depending on whether they correspond to cathode outputs situated in the centre of the cell or close to the heads, that is relative to their distance from the small axis of the cell so as to refine the layout of magnetic field, but still respecting the "direct path" as defined elsewhere. Generally speaking, the distance between the rods 9 situated on the side of the cell heads is smaller than the distance between the rods 9 situated in the centre of the cell. These rods 9 can also be equidistant.

In the absence of correcting conductors (all normal operation of the cells therefore being impossible), the values of the components of the magnetic field have been estimated by very reliable methods of calculation:

Bz maximum: $69.10^{-4}$ Tesla

Bz (quadratic mean): $35.10^{-4}$ Tesla

By: mean upstream/downstream interval: $2.6.10^{-4}$ Tesla (N.B. the interval at the antisymmetry of the values of By between upstream and downstream being defined as $|\overline{By}|$ upstream $-|\overline{By}|$ downstream).

Then, once the series is in operation and the internal and external correcting conductors have each been supplied with an intensity of 135 kA, these conductors being arranged at approximately 1.5 meters from the external wall of the metallic containers of the cells and the direction of the current in the two conductors being the same as that of the electrolysis current supplying the series (that is a total correction current J2=270 KA=56% J1), the Bz maximum: $14.10^{-4}$ Tesla Bz (quadratic mean): $5.10^{-4}$ Tesla By: mean upstream/downstream internal: $1.10^{-3}$ Tesla Finally, an adjacent line was simulated by a bundle of conductors arranged parallel to the axis OX, by considering that the axes in the real series and in the simulated series were 65 meters apart.

To compensate for the effects of this simulated adjacent line, the correcting conductor 16 placed on the side opposing the simulated adjacent line was supplied with 105 kA and the correcting conductor 21 placed on the side of the simulated adjacent line with 180 kA, that is a total correcting current J2=285 kA (60% of J1).

Measurement of the components of the magnetic field gave the following results:

Bz maximum: $23.10^{-4}$ Tesla

Bz (quadratic mean): $5.3.10^{-4}$ Tesla

By: mean upstream/downstream interval: $6.9.10^{-4}$ Tesla

The experimental series, with or without simulated and compensated adjacent line, has shown perfect stability in the layer of liquid aluminium, and absence of any asymmetrical erosion of the slopes and a Faraday yield of between 93 and 97%.

Finally, relative to a conventional solution without correcting conductors, the weight gain in all the conductors can be estimated at approximately 14,000 kg of aluminium per cell for this series having an electrolysis intensity of 480 kA. A gain of 350 mm over the distance between the axes from cell to cell is added to the foregoing, representing a saving of 84 meters in the building for a complete series of 240 cells.

Implementation of the invention therefore opens up the way to a new generation of electrolysis cells operating at an intensity which may attain and greatly exceed 500 kA with a remarkable stability and a Faraday yield at least equal to that of the preceding generations at 250–300 kA.

Example 2

To demonstrate that the invention is not limited to very high power electrolysis cells of the order of 500 kA, the invention was also applied to cells operating at 280 kA. As already explained in the statement of the invention, the use of the independent correcting circuit and of the modular design of conductors for connection from cell to cell again leads to a significant gain over the manufacturing and installations costs and costs for the surface area occupied by the buildings.

Figure 9:
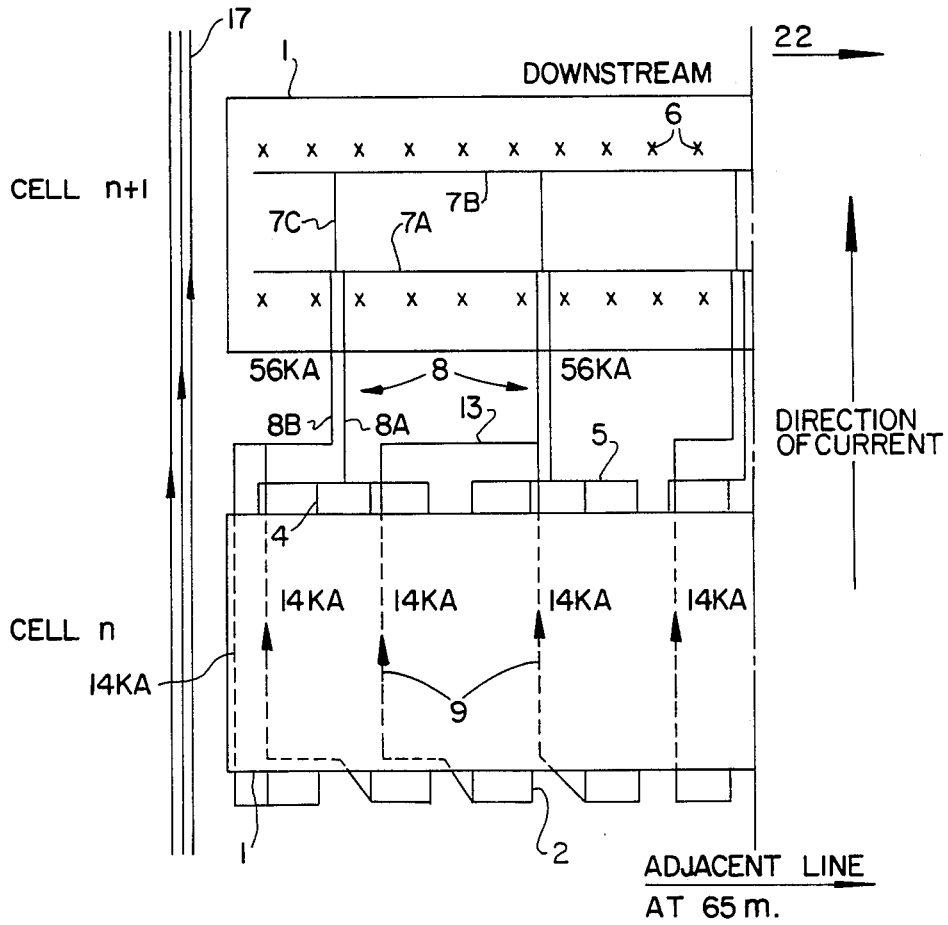

FIG. 9 shows two successive half cells in a series operating at 280 kA, with five modular risers 8 each transmitting 56 kA from the cell n towards the anode frame of the cell n+1 in the series.

Each independent correcting conductor 17, 27 is supplied with 90 kA in the absence of adjacent line, this current circulating in the same direction as the one supplying the actual series so as to effect electrolysis, that is a total correcting current J2 equal to 180 kA, therefore 64% of J1.

The following values (in Tesla) were found in normal operation at 280 kA, the two compensating conductors each being supplied with 90 kA:

Bz maximum: $18.10^{-4}$

Bz at quadratic mean: $4.6.10^{-4}$

Interval at antisymmetry By: $2.10^{-4}$

An adjacent line situated at 65 meters from the line under consideration was then simulated and the magnetic disturbance due to this line was compensated by increasing the compensating current in the internal independent conductor 27 situated on the side of the adjacent line from 90 to 120 kA and by reducing the current from 90 to 75 kA in the external independent conductor 17 situated on the side opposing the adjacent line (FIG. 5). The total correcting current is therefore brought to J2=195 kA, that is 70% of J1.

The following values were determined in Tesla:

Bz maximum: $22.10^{-4}$

Bz at quadratic mean: $4.9.10^{-4}$

Interval at antisymmetry By: $2.10^{-4}$

The cells supplied in this way demonstrated very stable operation and a current yield (Faraday yield) of between 93 and 95%.

In the case of 280 kA cells, the gain in weight over the conductors is not significant, on the contrary the gain of 270 mm over the distance between axes from cell to cell represents a saving of about 64 meters in length of the building for a complete series of 240 cells.

We claim:

1. In a circuit for electrical connection between two successive cells of rank n and rank n+1 in a series of cells for the production of aluminum by electrolysis of alumina dissolved in molten cryolite by the Hall-Heroult process at a total electrolysis current J1 of an intensity of at least 150 kA, and possibly attaining 500 to 600 kA, each cell being constituted by an insulated parallelepiped metal container of which the large axis is perpendicular to the axis of the series and of which the two tank ends comprise respectively, a left-hand head and a right-hand head, the container supporting a cathode formed by the juxtaposition of carbonaceous blocks in which there are sealed metal rods of which the rod ends issue from the container, generally on its two large upstream and downstream sides, relative to the direction of the current in the series, each cell also comprising an anode system formed by at least one horizontal rigid beam supporting at least one horizontal conducting rod comprising an anode frame on which anode suspension shafts are attached, the connecting circuit comprising, a circuit for the transmission of electrolysis current between two successive cells constituted by cathode collectors connected to the cathode outputs of the cell in rank n and to the connecting conductors which join, via risers, the anode frame on the cell of rank n+1 in the series, the improvement comprising, in addition to the circuit for the transmission of electrolysis current, a distinct circuit comprising means for the correction and balancing of the magnetic fields and which comprises a first conductor which is substantially parallel to the axis of the series and adjacent to said left-hand heads, and a second conductor which is substantially parallel to the axis of the series and adjacent to said right-hand heads, said first and second conductors being adapted to be traversed by a direct current J2 in the same direction as the electrolysis current and which creates in the cells a vertical correcting magnetic field which is directed downwards close to the left-hand heads and is directed upwards close to the right-hand heads.

2. An electrical connecting circuit according to claim 1, wherein the total current J2 traversing the magnetic correcting circuit is equal to, or less than, the electrolysis current J1.

3. A connecting circuit according to claim 1, wherein the current J2 is between 5 and 80% of J1.

4. A connecting circuit according to claim 1, wherein the current J2 is between 20 and 70% of J1.

5. A connecting circuit according to claim 1, wherein the electrolysis current supply circuit comprises:

(a) the upstream cathode outputs 2 of the cell in rank n being connected to upstream cathode collectors 3 which directly join, via conductors 9 of which the majority passes beneath said cell n, a first section (half riser) 8A of the risers 8 which supply the anode bus 7 of the cell of rank n+1 in the series; and (b) the downstream cathode outputs 4 of the cell of rank n being connected to downstream cathode collectors 5 directly connected to a second section (half risers) 8B of the risers 8.

6. A connecting circuit according to claim 1, wherein the electrolysis current circuit comprises:

(a) on the large upstream side, two adjacent cathode outputs 2 are joined by a collector 3 connected to a rod 9 passing beneath the cell, each group of two adjacent rods 9 joining a connecting conductor 13, upstream, which is itself connected to a half riser 8A; and (b) on the large downstream side, four adjacent cathode outputs 3 are connected to the other corresponding half riser 8B.

7. A connecting circuit according to claims 5 or 6, wherein the connecting rods 9 arranged beneath the container are equidistant.

8. A connecting circuit according to claims 5 or 6, wherein the distance between the connecting rods 9 is altered as a function of their position relative to the small axis of the cell.

9. A connecting circuit according to claims 5 or 6, wherein the distance between the connecting rods 9 situated on the side of the heads of the cell is smaller than the distance between the connecting rods situated in the center of the cell.

10. A connecting circuit according to claim 1, wherein the circuit for correcting and balancing the magnetic fields is constituted by two assemblies of correcting conductors 17, 22 which are independent from the electrolysis current supply conductors, are arranged on either side of the series of cells parallel to the axis of the line and are supplied with a total current J2 circulating in the same direction as the current J1 which supplies the series of cells and at an intensity equal to, or less than, current J1.

11. A connecting device according to claim 1, wherein the compensating first & second conductors are arranged at a short distance from the metal container of the cells and substantially at the height of a metallic layer of molten aluminium present during operation of the cell.

12. A connecting device according to claim 1, wherein the portion of the electrolysis current supply circuit providing the connection between the cathode collectors 2, 4 of the cell of rank n to the anode frame 7 of the cell of rank n+1 in the line comprises substantially identical modules 14 each corresponding to a riser 8.

13. A connecting device according to claim 12, wherein each module 14 comprises:

(a) four downstream cathode outputs 4 of the cell n;

(b) the downstream cathode collector 5 and the half riser 8A towards the anode frame 7A of the cell n+1;

(c) a connecting conductor 13 joining on the one hand to two rods 9 passing beneath the cell n and on the other hand to the other half riser 8B; and (d) two upstream cathode collector elements 3, 3' each joined to two upsteram cathode outputs of the cell n+1.

14. A connecting circuit according to claim 1, wherein said series of cells comprises at least two lines of cells arranged in parallel, wherein the correcting conductors located between two lines of cells are internal conductors, and the correcting conductors not located between two lines of cells are external conductors, and wherein said internal conductors are adapted to be traversed by a current having an intensity higher than that traversing said external conductors.

* * * * *